US011420456B2

(12) United States Patent
Ishikura

(10) Patent No.: US 11,420,456 B2
(45) Date of Patent: Aug. 23, 2022

(54) MOVEMENT MECHANISM AND PRINTING APPARATUS

(71) Applicant: SEIKO EPSON CORPORATION, Tokyo (JP)

(72) Inventor: Takuro Ishikura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 72 days.

(21) Appl. No.: 17/028,436

(22) Filed: Sep. 22, 2020

(65) Prior Publication Data

US 2021/0086533 A1 Mar. 25, 2021

(30) Foreign Application Priority Data

Sep. 25, 2019 (JP) ..... JP2019-174006

(51) Int. Cl.
*B41J 19/00* (2006.01)
*B41J 2/045* (2006.01)
*B41J 19/20* (2006.01)

(52) U.S. Cl.
CPC ..... *B41J 19/005* (2013.01); *B41J 2/04586* (2013.01); *B41J 19/202* (2013.01)

(58) Field of Classification Search
CPC ..... B41J 19/005; B41J 19/202; B41J 2/04586
See application file for complete search history.

(56) References Cited

U.S. PATENT DOCUMENTS 9,506,536 B2 * 11/2016 Sato ..... F16H 7/02
2013/0194347 A1 * 8/2013 Terada ..... B41J 19/005 347/37

FOREIGN PATENT DOCUMENTS

JP 2017-154263 9/2017
WO WO-2019221741 A1 * 11/2019 ..... B41J 11/007

* cited by examiner

*Primary Examiner* — Thinh H Nguyen
(74) *Attorney, Agent, or Firm* — Workman Nydegger

(57) ABSTRACT

A movement mechanism for a movable body including a motor including a rotation shaft, a supporting member that supports the motor, an attachment member fixed to a base body portion and to which the supporting member is attached, a driving pulley coupled to the rotation shaft, a driven pulley attached to the base body portion, an endless belt stretched between the driving pulley and the driven pulley, and the movable body attached to the endless belt, in which the supporting member is configured to be pivotally movable about a position serving as a pivotal axis such that a distance between the driving pulley and the driven pulley shortens, the position being at a side of the driven pulley from the driving pulley in a stretching direction in which the endless belt is stretched between the driving pulley and the driven pulley.

9 Claims, 7 Drawing Sheets

MOVEMENT MECHANISM AND PRINTING APPARATUS

The present application is based on, and claims priority from JP Application Serial Number 2019-174006, filed Sep. 25, 2019, the disclosure of which is hereby incorporated by reference herein in its entirety.

BACKGROUND

1. Technical Field

The present disclosure relates to a movement mechanism and a printing apparatus.

2. Related Art

In the related art, a movement mechanism is used which is configured to cause a movable body to move using an endless belt stretched between a driving pulley and a driven pulley, such as a printing apparatus configured to perform printing while causing a carriage equipped with a head configured to discharge ink to reciprocally move with respect to a medium. For example, JP 2017-154263 A discloses a printer configured to cause the carriage to move using a timing belt stretched between the driving pulley and the driven pulley.

A known movement mechanism configured to cause the movable body to move using the endless belt stretched between the driving pulley and the driven pulley, as used in the printer disclosed in JP 2017-154263 A, imposes a large burden on an operator who is to replace the motor configured to cause the driving pulley to rotate. This is because, when replacing the motor in such a movement mechanism, a tension exerted on the endless belt needs to be once relaxed to remove an old motor, and the tension exerted on the endless belt needs to be fine adjusted using a belt tensiometer or the like after attaching a new motor. Under such a circumstance, an object of the present disclosure is to facilitate a replacement of the motor configured to cause the endless belt stretched between the driving pulley and the driven pulley to rotate.

SUMMARY

A movement mechanism according to the present disclosure for achieving the above-described object is a movement mechanism for a movable body, the movement mechanism including a motor including a rotating shaft, a supporting member configured to support the motor, an attachment member fixed to a base body portion and to which the supporting member is attached, a driving pulley coupled to the rotation shaft, a driven pulley attached to the base body portion, an endless belt stretched between the driving pulley and the driven pulley, and the movable body attached to the endless belt, in which the supporting member is configured to be pivotally movable about a position serving as a pivotal axis such that a distance between the driving pulley and the driven pulley shortens, the position being at a side of the driven pulley from the driving pulley in a stretching direction in which the endless belt is stretched between the driving pulley and the driven pulley.

DESCRIPTION OF EXEMPLARY EMBODIMENTS

Figure 1:
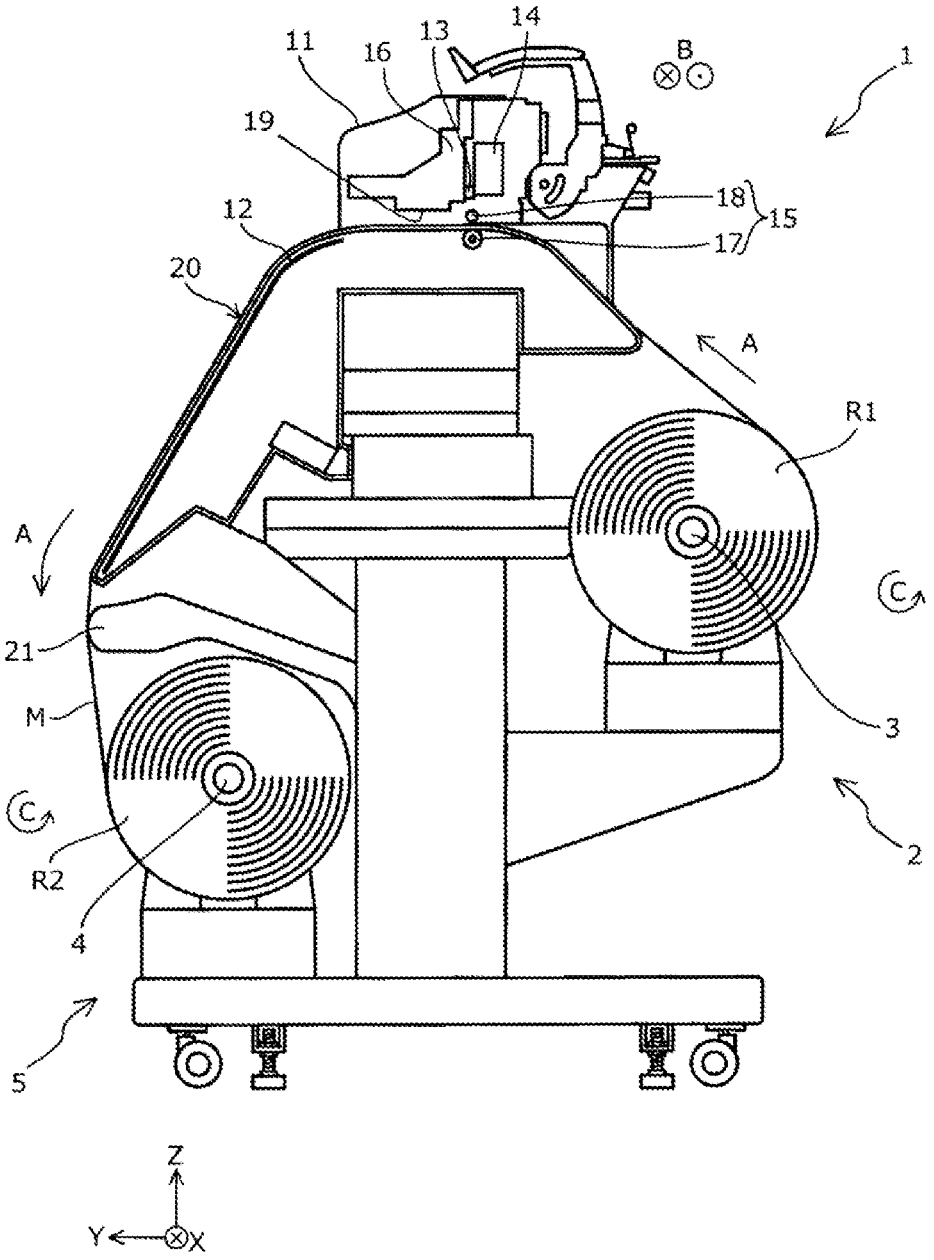
FIG. 1 is a view schematically illustrating a printing apparatus according to an example of the present disclosure.

First, the present disclosure will be schematically described.

A movement mechanism according to a first aspect of the present disclosure for achieving the above-described object is a movement mechanism for a movable body, the movement mechanism including a motor including a rotation shaft, a supporting member configured to support the motor, an attachment member fixed to a base body portion and to which the supporting member is attached, a driving pulley coupled to the rotation shaft, a driven pulley attached to the base body portion, an endless belt stretched between the driving pulley and the driven pulley, and the movable body attached to the endless belt, in which the supporting member is configured to be pivotally movable about a position serving as a pivotal axis such that a distance between the driving pulley and the driven pulley shortens, the position being at a side of the driven pulley from the driving pulley in a stretching direction in which the endless belt is stretched between the driving pulley and the driven pulley.

According to the first aspect, the supporting member for supporting the motor is configured to be pivotally movable, such that the distance between the driving pulley and the driven pulley shorten, at the position on the side of the driven pulley from the driving pulley in the stretching direction. This allows the motor to be replaceable without relaxing and readjusting a tension exerted on the endless belt, to thus facilitate a replacement of the motor.

A movement mechanism according to a second aspect of the present disclosure is the movement mechanism according to the first aspect, in which the supporting member includes, at an end portion on the side of the driven pulley, a stretching direction-side abutting portion abutting against the attachment member in the stretching direction, in which the stretching direction-side abutting portion, and a stretching direction-side abutted portion of the attachment member constitute the pivotal axis, in which the stretching direction-side abutting portion abuts against the stretching direction-side abutted portion.

According to the second aspect, the stretching direction-side abutting portion of the supporting member and the stretching direction-side abutted portion of the attachment member can simply constitute the pivotal axis, and can cause the supporting member to be suitably positioned with respect to the attachment member in the stretching direction.

A movement mechanism according to a third aspect of the present disclosure is the movement mechanism according to the second aspect, in which a plurality of pairs of the stretching direction-side abutting portion and the stretching direction-side abutted portion are provided to constitute the pivotal axis.

According to the third aspect, the plurality of pairs of the stretching direction-side abutting portion and the stretching direction-side abutted portion are provided to enable the plurality of pairs of the stretching direction-side abutting portion and the stretching direction-side abutted portion to cause the supporting member to be particularly suitably positioned with respect to the attachment member in the stretching direction.

A movement mechanism according to a fourth aspect of the present disclosure is the movement mechanism according to any one of the first to third aspects, in which the supporting member is fastened to the attachment member at an opposite side of the driving pulley from the side of the driven pulley in the stretching direction.

According to the fourth aspect, the supporting member, which is fastened at the opposite side of the driving pulley from the side of the driven pulley in the stretching direction, that is, at an opposite side from the rotation shaft, can be fixed at a suitable position with respect to the attachment member in the stretching direction.

A movement mechanism according to a fifth aspect of the present disclosure is the movement mechanism according to the fourth aspect, in which the supporting member is fastened at a plurality of locations to the attachment member, at the opposite side of the driving pulley from the side of the driven pulley in the stretching direction.

According to the fifth aspect, the supporting member, which is fastened at the plurality of locations to the attachment member, can be firmly fixed at a suitable position with respect to the attachment member in the stretching direction.

A movement mechanism according to a sixth aspect of the present disclosure is the movement mechanism according to the fourth or fifth aspect, in which the supporting member is further fastened to the attachment member at the side of the driven pulley from the driving pulley in the stretching direction.

According to the sixth aspect, the supporting member, which is further fastened at the side of the driven pulley, can be particularly firmly fixed with respect to the attachment member in the stretching direction.

A movement mechanism according to a seventh aspect of the present disclosure is the movement mechanism according to any one of the first to sixth aspects, in which the motor, the supporting member, and the driving pulley are configured to be integrally movable and removable with respect to the attachment member.

According to the seventh aspect, the motor, the supporting member, and the driving pulley, which are configured to be integrally movable and removable with respect to the attachment member, can be collectively replaceable and movable, to thus particularly facilitate a replacement of the motor.

A movement mechanism according to an eighth aspect of the present disclosure is the movement mechanism according to any one of the first to seventh aspects, in which the supporting member includes, at an end portion in an intersecting direction intersecting the stretching direction, an intersecting direction-side abutting portion abutting against the attachment member, in which the intersecting direction-side abutting portion abuts against an intersecting direction-side abutted portion of the attachment member.

According to the eighth aspect, the intersecting direction-side abutting portion of the supporting member and the intersecting direction-side abutted portion of the attachment member can cause the supporting member to be suitably positioned with respect to the attachment member in the intersecting direction.

A printing apparatus according to a ninth aspect of the present disclosure includes the movement mechanism according to any one of the first to eighth aspects, in which the movable body includes a carriage equipped with a head configured to discharge ink.

According to the ninth aspect, it is possible to facilitate a replacement of the motor configured to cause the carriage equipped with the head configured to discharge ink to move.

Hereinafter, an embodiment of the present disclosure will be described with reference to the drawings. First, an overview of a printing apparatus 1 according to an example of the present disclosure will be described with reference to FIG. 1. Note that, in FIG. 1, some components are omitted for clarity of configuration. Here, in the figures, an X-axis direction coincides with the horizontal direction, which is a direction in which a shaft portion 4 of a medium set unit 2 extends, a Y-axis direction coincides with the horizontal direction, which is a direction orthogonal to the X-axis direction, and a Z-axis direction coincides with the vertical direction. Additionally, hereinafter, it is assumed that an arrow direction is a + direction, and a direction opposite to the arrow direction is a − direction. For example, it is assumed that a vertical upward direction is a +Z direction, and a vertical downward direction is a −Z direction.

The printing apparatus 1 of the example includes the medium set unit 2 for supporting a roll body R1 wound with a medium M of sheet-like form for printing. Further, in the printing apparatus 1 of the example, when transporting the medium M in a transport direction A, a shaft portion 3 of the medium set unit 2 rotates in a rotation direction C. Note that the example uses the roll body R1 wound such that a printing surface on which printing is performed faces outward, and when using the roll body R1 wound such that the printing surface faces inward, the shaft portion 3 can be rotated in a direction opposite to the rotation direction C to feed out the medium M from the roll body R1.

The printing apparatus 1 of the example also includes a transport path on which the medium M is transported, where the transport path is constituted by a medium supporting unit 20 for supporting the medium M, and the like. The printing apparatus 1 further includes a transport roller pair 15 constituted by a driving roller 17 and a driven roller 18 configured to transport the medium M in the transport direction A on the transport path. Note that in the printing apparatus 1 of the example, the driving roller 17 is constituted by a roller extending in a width direction B intersecting the transport direction A, and a plurality of the driven rollers are provided side by side at positions facing the driving roller 17, in the width direction B, with respect to the driving roller 17. However, a configuration of a transporting unit of the medium M is not limited to a particular configuration.

There is also provided a heater 12 configured to heat the medium M supported by the medium supporting unit 20, at a lower portion of the medium supporting unit 20. However, a configuration may also be employed in which no heating unit configured to heat the medium M is provided.

The printing apparatus 1 of the example further includes, inside a housing portion 11, a head 19 provided with a plurality of nozzles and configured to allow the nozzles to discharge inks to perform printing, and a carriage 16 mounted with the head 19 and configured to reciprocally move in the width direction B. Note that in the printing apparatus 1 of the example, the transport direction A at a position facing the head 19 above the medium supporting unit 20 coincides with a +Y-axis direction, a movement direction in which the head 19 moves coincides with a direction along the X-axis direction, and a discharge direction in which inks are to be discharged coincides with a −Z-axis direction.

Here, inside the housing portion 11, a frame 14 as a base body portion is formed, and a guide rail 13 attached to the frame 14 and provided extending along the X-axis direction is formed. Further, the carriage 16 equipped with the head 19 is attached to the guide rail 13. Note that a movement mechanism 30 of the carriage 16, which is a main part of the printing apparatus 1 of the example, is illustrated in FIGS. 2 to 7, and the movement mechanism 30 of the carriage 16 will be described in detail below.

The configuration described above enables the head 19 to cause non-illustrated nozzles to discharge inks onto the medium M being transported while the head 19 reciprocally moves in the transport direction B intersecting the transport direction A, to thus perform printing. The printing apparatus 1 of the example is configured to repeat transporting the medium M in the transport direction A by a predetermined amount of transportation and causing the head 19 to discharge ink while causing the head 19 to move in the width direction B in a state of stopping transporting the medium M, to thus form a desired image onto the medium M.

Further, a medium winding unit 5 configured to wind the medium M as a roll body R2 is provided downstream in the transport direction A of the head 19. Note that, in the example, the medium M is wound to allow the printing surface to face outward, and thus, when winding the medium M, the shaft portion 4 of the medium winding unit 5 rotates in the rotation direction C. On the other hand, when carrying out winding of the medium M to allow the printing surface to face inward, the shaft portion 4 rotates in the direction opposite to the rotation direction C to wind the medium M.

In addition, a tension bar 21 is provided between an end portion downstream in the transport direction A of the medium supporting unit 20 and the medium winding unit 5, where the tension bar 21 includes a contact portion extending in the width direction B and configured to make a contact with the medium M to apply a desired tension to the medium M. However, a configuration may also be employed in which no tension bar 21 is provided.

Figure 2:
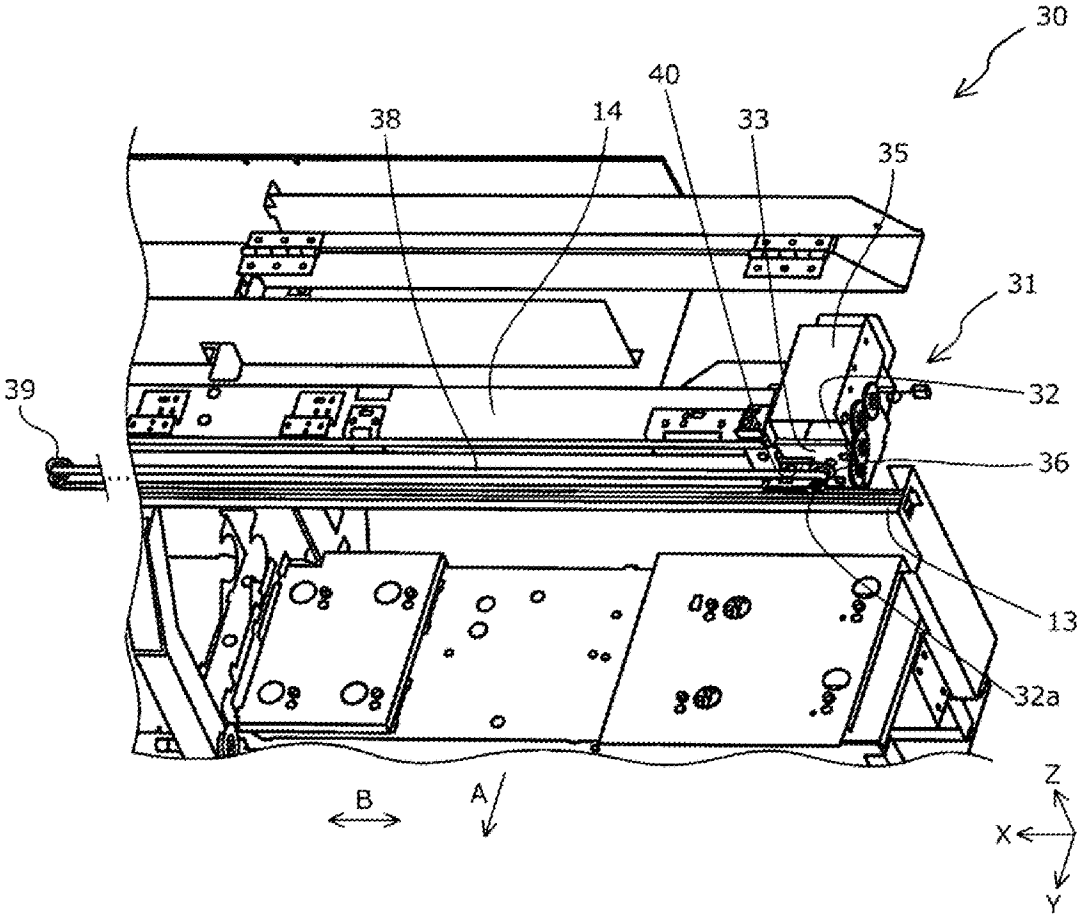
FIG. 2 is a perspective view of a movement mechanism of a carriage of a printing apparatus of FIG. 1.
Figure 3:
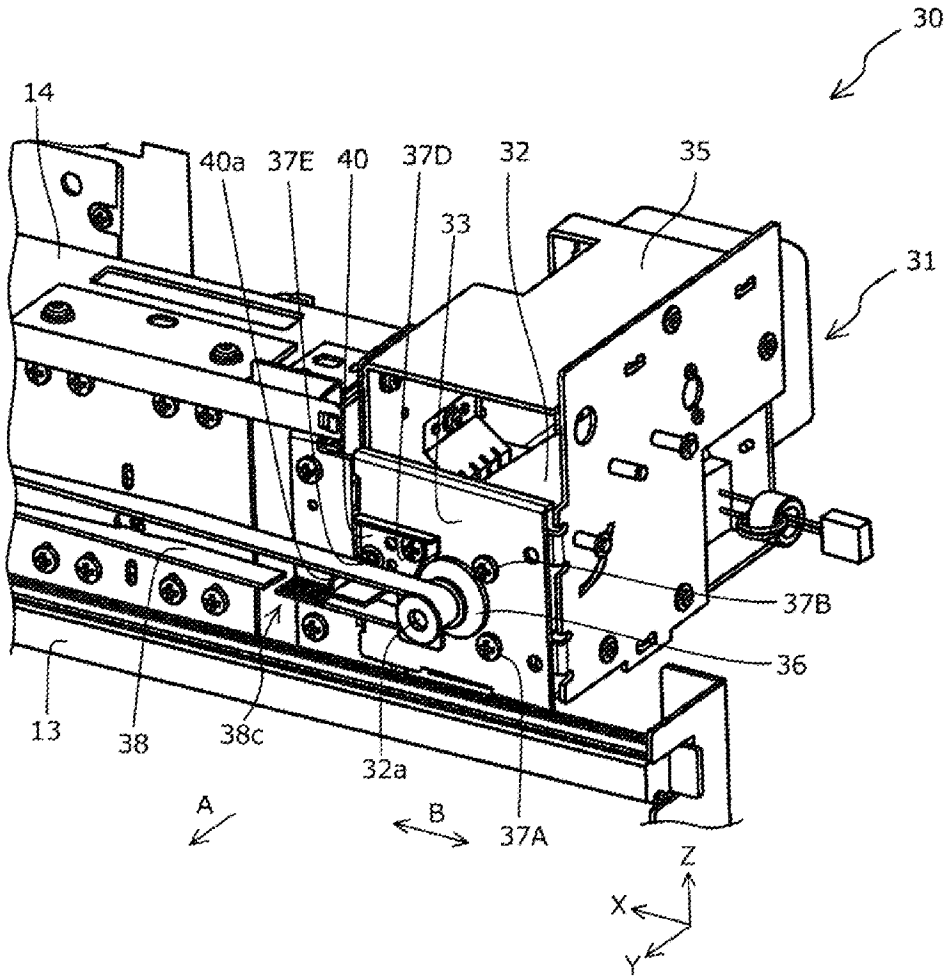
FIG. 3 is a perspective view of a carriage movement mechanism viewed from an angle different from FIG. 2 with some components removed.
Figure 4:
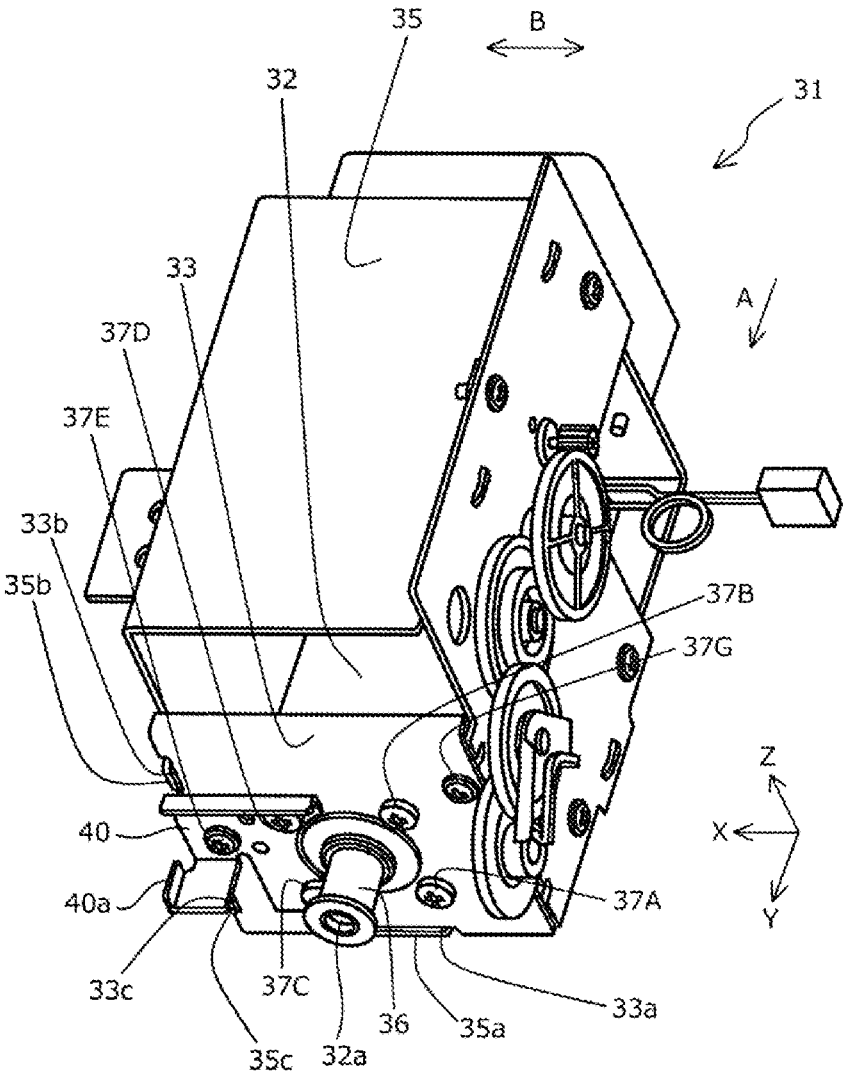
FIG. 4 is a perspective view of a driving unit in a movement mechanism of the carriage of FIGS. 2 and 3.
Figure 5:
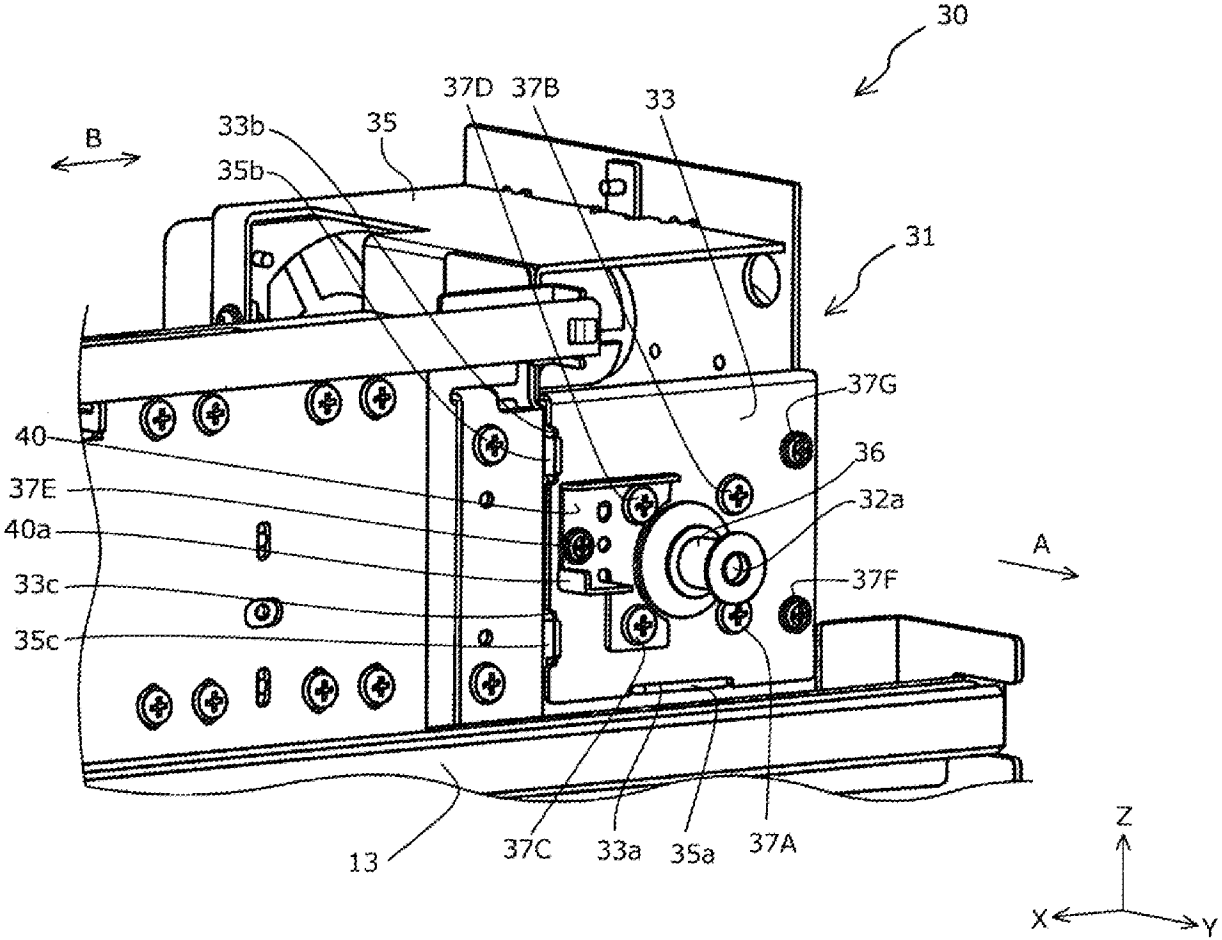
FIG. 5 is a perspective view of a driving unit viewed from an angle different from FIG. 4 with some components removed.
Figure 6:
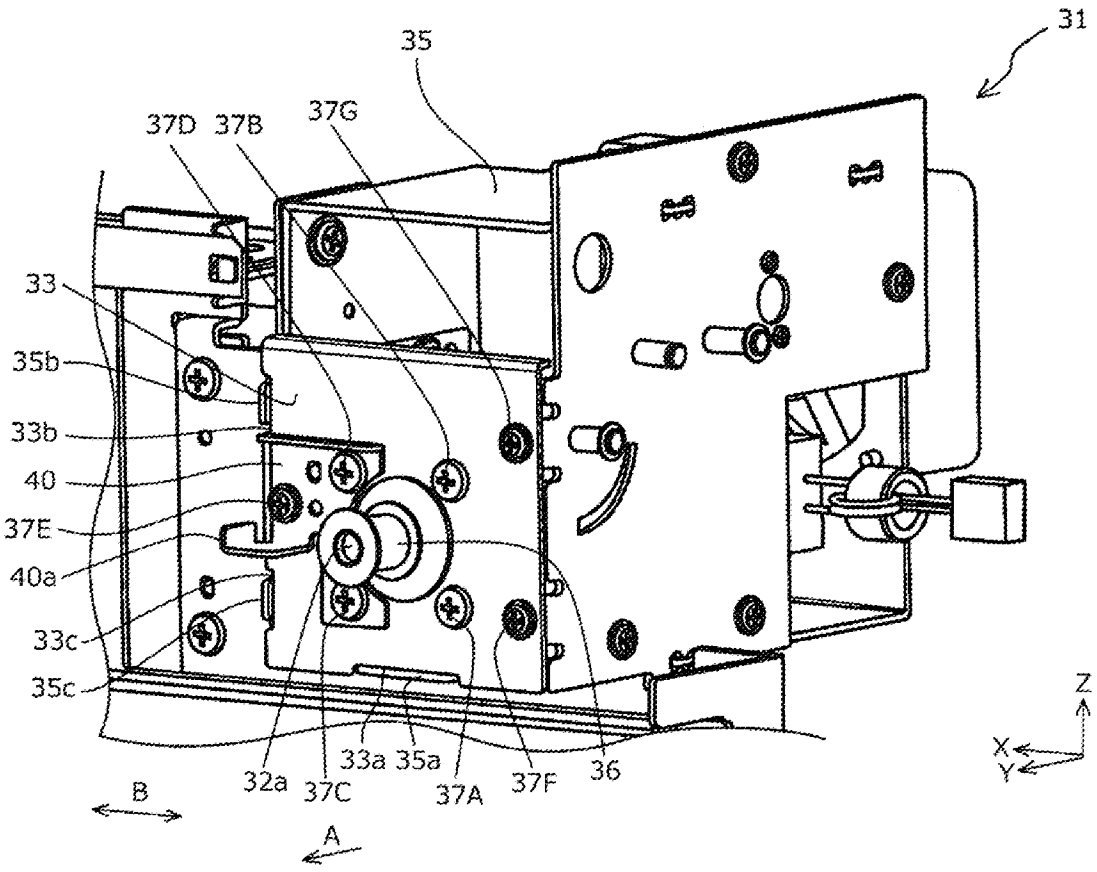
FIG. 6 is a perspective view of a driving unit viewed from an angle different from FIGS. 4 and 5 with some components removed.

Next, a description of the movement mechanism 30 of the carriage 16, which is a main part of the printing apparatus 1 of the example, will be given with reference to FIGS. 2 to 7. As illustrated in FIGS. 2 and 3, the movement mechanism 30 of the example includes a motor 32 including a rotation shaft 32*a*, a supporting member 33 for supporting the motor 32, and an attachment member 35 fixed to the frame 14 and to which the supporting member 33 is attached, a driving pulley 36 coupled to the rotation shaft 32*a*, a driven pulley 39 attached to the frame 14, and an endless belt 38 stretched between the driving pulley 36 and the driven pulley 39. Further, the carriage 16 as a movable body is attached to the endless belt 38. Note that, in FIG. 3, a part of the endless belt 38 is made transparent to make a tension adjustment unit 38*c* at the endless belt 38 easily recognizable.

The endless belt 38, which is composed of a stretchy material, is stretched between the driving pulley 36 and the driven pulley 39 in a state where a predetermined tension is being applied to the endless belt 38. In a movement mechanism of the related art, when replacing the motor, it is necessary that the tension exerted on the endless belt is temporarily relaxed, the endless belt is removed from the driving pulley and the driven pulley, the motor is replaced, the endless belt is stretched between the driving pulley and the driven pulley, and to then adjust the tension exerted on the endless belt. Adjusting the tension exerted on the endless belt needs to be done using a dedicated instrument such as a belt tensiometer in a narrow space, which imposes a large burden on an operator.

Here, as illustrated in FIGS. 3 to 7, the motor 32, the supporting member 33, the attachment member 35, and the driving pulley 36 constitute a driving unit 31 in the movement mechanism 30 of the carriage 16. The motor 32 is fixed to the supporting member 33 by screws 37A, 37B, 37C, and 37D. The supporting member 33 is attached with a contact plate 40 including a contact portion 40*a* that makes contact with the carriage 16 when the carriage 16 configured to reciprocally move in the width direction B comes to move in the −X direction. The screws 37C and 37D are used to fix the contact plate 40 to the supporting member 33 together with a screw 37E.

In addition, the supporting member 33 is attached to the attachment member 35 by being fixed by screws, and the screw 37E is also used to fix the supporting member 33 to the attachment member 35. Note that screws 37F and 37G are also used to fix the supporting member 33 to the attachment member 35 together with the screw 37E.

A positioning of the supporting member 33 with respect to the attachment member 35 is conducted in the Y-axis direction in such a way that the screws 37E, 37F, and 37G are used for fixation. In addition, in the Z-axis direction, the positioning is conducted in such a way that an abutting portion 33*a* at an end portion on a side in the −Z direction of the supporting member 33 is caused to abut against an abutted portion 35*a* provided at the attachment member 35. Further, in the X-axis direction, the positioning is conducted in such a way that abutting portions 33*b* and 33*c* at an end portion on a side in the +X direction of the supporting member 33 is caused to abut against abutted portions 35*b* and 35*c* provided at the attachment member 35.

Here, as illustrated in FIGS. 2 to 7, the attachment member 35 has a tube-like configuration, where the motor 32 is disposed at an interior of the attachment member 35. Further, the motor 32 is disposed creating a gap between the motor 32 and the interior of the attachment member 35. In the movement mechanism 30 of the example, which is configured as such, a removal of the screws 37E, 37F, and 37G enables the supporting member 33 in a state of being attached with the motor 32 to pivotally move with respect to the attachment member 35 about the end portion on the side in the +X direction of the supporting member 33, which is, specifically, the abutting portions 33*b* and 33*c* and the abutted portions 35*b* and 35*c*, which serve as pivotal axes along the Z-axis direction. That is, in the movement mechanism 30 of the example, the supporting member 33 in a state of being attached with the motor 32 is allowed to pivotally move with respect to the attachment member 35, from a state illustrated in FIGS. 2 and 3 to a state illustrated in FIG. 7. In the state illustrated in FIG. 7, a distance from the driving pulley 36 to the driven pulley 39 is shortened and a stretching distance by which the endless belt 38 is stretched is shortened, which allows the endless belt 38 to be easily removable from the driving pulley 36 and the driven pulley 39.

Figure 7:
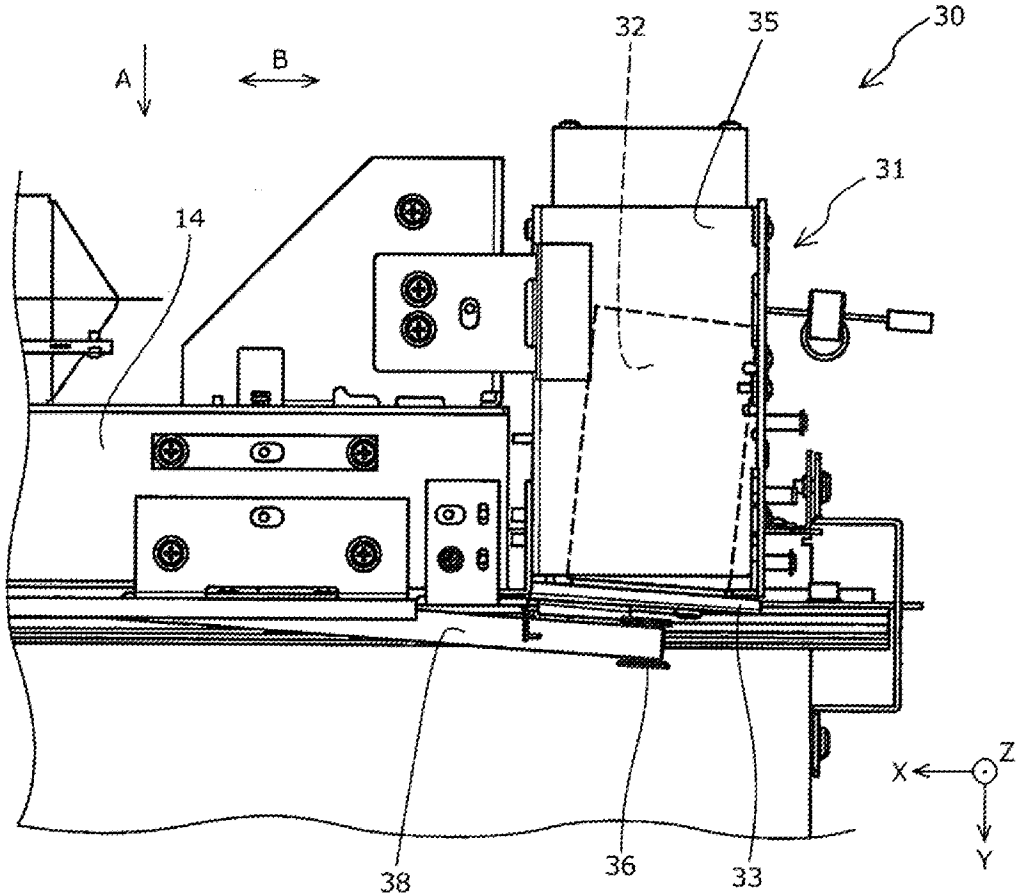
FIG. 7 is a plan view of a supporting member of a motor in a driving unit, which is pivotally moved from a state in FIGS. 2 and 3.

In the movement mechanism 30 of the example configured as such, the supporting member 33 is caused to pivotally move with respect to the attachment member 35 as illustrated in FIG. 7 when replacing the motor 32, and the endless belt 38 is removed from the driving pulley 36 and the driven pulley 39, to complete a replacement of the motor 32. Then, as illustrated in FIG. 7, the supporting member 33 is caused to be in a state of being pivotally moved with respect to the attachment member 35, where the endless belt 38 is caused to be stretched between the driving pulley 36 and the driven pulley 39 again without adjusting a tension exerted on the endless belt 38 as is, and the supporting member 33 is caused to pivotally move with respect to the attachment member 35 to return to the state illustrated in FIGS. 2 and 3, to thus enable the replacement of the motor 32 without adjusting the tension exerted on the endless belt 38. That is, the movement mechanism 30 of the example, which is configured as such, enables the endless belt 38, when replacing the motor 32, to be stretched between the driving pulley 36 and the driven pulley 39 without adjusting the tension by applying the principle of leverage.

In other words, the supporting member 33 of the example is configured to be pivotally movable about a position serving as a pivotal axis such that the distance between the driving pulley 36 and the driven pulley 39 shortens, where the position is at a side of the driven pulley 39 from the driving pulley 36 (on the side in the +X direction) in the stretching direction (in the width direction B) in which the endless belt 38 is stretched by the driving pulley 36 and the driven pulley 3. Accordingly, the movement mechanism 30 of the example enables the motor 32 to be replaceable without relaxing and readjusting the tension exerted on the endless belt 38, to thus facilitate the replacement of the motor 32.

In further other words, the supporting member 33 of the example includes, at an end portion on the side of the driven pulley 39, which is on the side in the +X direction, the abutting portions 33*b* and 33*c* as stretching direction-side abutting portions, which abut against the attachment member 35 in the stretching direction (in the width direction B) in which the endless belt 38 is stretched. Further, the abutting portions 33*b* and 33*c*, and the abutted portions 35*b* and 35*c* as stretching direction-side abutted portions of the attachment member 35 constitute the pivotal axes along the Z-axis direction, where the abutting portions 33*b* and 33*c* abut against the abutted portions 35*b* and 35*c*. As such, the movement mechanism 30 of the example enables the stretching direction-side abutting portions of the supporting member 33 and the stretching direction-side abutted portions of the attachment member 35 to simply constitute the pivotal axes, and to cause the supporting member 33 to be suitably positioned with respect to the attachment member 35 in the stretching direction in which the endless belt 38 is stretched.

As described above, the supporting member 33 of the example also includes, at the end portion in the −Z direction as an intersecting direction intersecting the stretching direction in which the endless belt 38 is stretched, the abutting portion 33*a* as an intersecting direction-side abutting portion abutting against the attachment member 35, where the abutting portion 33*a* abuts against the abutted portion 35*a* as an intersecting direction-side abutted portion of the attachment member 35. Accordingly, the supporting member 33 of the example enables the intersecting direction-side abutting portion of the supporting member 33 and the intersecting direction-side abutted portion of the attachment member 35 to cause the supporting member 33 to be suitably positioned with respect to the attachment member 35 in the intersecting direction.

Note that, as described above, the supporting member 33 of the example includes two portions of the abutting portion 33*b* and the abutting portion 33*c* as the stretching direction-side abutting portions, and includes two portions of the abutted portion 35*b* and the abutted portion 35*c* as the stretching direction-side abutted portions. That is, in the supporting member 33 of the example, a plurality of pairs of the stretching direction-side abutting portion and the stretching direction-side abutted portion are provided to constitute the pivotal axes composed of the stretching direction-side abutting portion and the stretching direction-side abutted portion. Accordingly, the movement mechanism 30 of the example enables the plurality of pairs of the stretching direction-side abutting portion and the stretching direction-side abutted portion to cause the supporting member 33 to be particularly suitably positioned with respect to the attachment member 35 in the width direction B.

Further, as described above, the supporting member 33 of the example is fastened to the attachment member 35 by the screws 37F and 37G at an opposite side of the driving pulley 36 from the side of the driven pulley 39 (on a side in the −X direction) in the width direction B. As such, the supporting member 33, which is fastened to the attachment member 35 at an opposite side from the rotation shaft 32*a*, can be fixed with respect to the attachment member 35 at a suitable position separated from the rotation shaft 32*a* in the width direction B. In particular, the supporting member 33 of the example, which is fastened at two locations of the screw 37F and the screw 37G, that is, at a plurality of locations to the attachment member 35, can be firmly fixed with respect to the attachment member 35 at a suitable position in the width direction B.

Moreover, as described above, the supporting member 33 of the example is further fastened to the attachment member 35 by the screw 37E at a position on a side of the driven pulley 39 from the driving pulley 36 (on the side in the +X direction) in the width direction B. The supporting member 33 of the example, which is further fastened to the attachment member 35 at the position on the side of the driven pulley 39, can be particularly firmly fixed to the attachment member 35 in the width direction B.

As described above, in the movement mechanism 30 of the example, the motor 32 is fixed to the supporting member 33 by screws, as well as the driving pulley 36 is coupled to the rotation shaft 32*a* of the motor 32. Further, the supporting member 33 is configured to be pivotally movable with respect to the attachment member 35. That is, the movement mechanism 30 of the example enables the motor 32, the supporting member 33, and the driving pulley 36 to be integrally movable and removable with respect to the attachment member 35. This enables the motor 32, the supporting member 33, and the driving pulley 36 to be collectively replaceable and movable, to thus particularly facilitate the replacement of the motor 32.

To give a description about the above from a perspective of the printing apparatus, the printing apparatus 1 of the example includes the movement mechanism 30 having the configuration described above, and includes the carriage 16 equipped with the head 19 configured to discharge ink as the movable body that is caused to move by the movement mechanism 30. Such a configuration enables the printing apparatus 1 of the example to facilitate the replacement of the motor 32 configured to cause the carriage 16 equipped with the head 19 that is configured to discharge ink to move.

The present disclosure is not limited to the examples described above, and can be materialized in various configurations without departing from the gist of the present disclosure. For example, appropriate replacements or combinations may be made to the technical features in the examples which correspond to the technical features in the aspects described in the SUMMARY section to solve some or all of the issues described above, or to achieve some or all of the advantageous effects described above. Additionally, the technical features, when not described in this specification as essential matters, may be deleted appropriately.

What is claimed is:

1. A movement mechanism for a movable body, comprising:

a motor including a rotation shaft;

a supporting member configured to support the motor;

an attachment member fixed to a base body portion, the supporting member being attached to the attachment member;

a driving pulley coupled to the rotation shaft;

a driven pulley attached to the base body portion;

an endless belt stretched between the driving pulley and the driven pulley, and that is removably attached to the driving pulley such that when tension on the endless belt is reduced due to movement of the driving pulley towards the driven pulley, the endless belt is removable from the driving pulley; and the movable body attached to the endless belt, wherein the supporting member is configured to be pivotally movable about a pivotal axis such that a distance between the driving pulley and the driven pulley shortens, the pivotal axis being at a side of the supporting member that is towards the driven pulley from the driving pulley in a stretching direction in which the endless belt is stretched between the driving pulley and the driven pulley, the pivotal axis being perpendicular to an axis by which the driven pulley rotates about the rotation shaft.

2. The movement mechanism according to claim 1, wherein the supporting member includes, at an end portion on the side of the driven pulley, a stretching direction-side abutting portion abutting against the attachment member in the stretching direction, wherein the stretching direction-side abutting portion, and a stretching direction-side abutted portion of the attachment member, constitute the pivotal axis, the stretching direction-side abutting portion abutting against the stretching direction-side abutted portion.

3. The movement mechanism according to claim 2, wherein a plurality of pairs of the stretching direction-side abutting portion and the stretching direction-side abutted portion are provided to constitute the pivotal axis.

4. The movement mechanism according to claim 1, wherein the supporting member is fastened to the attachment member at an opposite side of the driving pulley from the side of the driven pulley, in the stretching direction.

5. The movement mechanism according to claim 4, wherein the supporting member is fastened to the attachment member at a plurality of locations, the supporting member being fastened at the opposite side of the driving pulley from the side of the driven pulley, in the stretching direction.

6. The movement mechanism according to claim 4, wherein the supporting member is further fastened to the attachment member at the side of the driven pulley from the driving pulley, in the stretching direction.

7. The movement mechanism according to claim 1, wherein the motor, the supporting member, and the driving pulley are configured to be integrally movable and removable with respect to the attachment member.

8. The movement mechanism according to claim 1, wherein the supporting member includes, at an end portion in an intersecting direction intersecting the stretching direction, an intersecting direction-side abutting portion abutting against the attachment member, and the intersecting direction-side abutting portion abuts against an intersecting direction-side abutted portion of the attachment member.

9. A printing apparatus, comprising the movement mechanism according to claim 1, wherein the movable body includes a carriage including a head configured to discharge ink.

* * * * *